US009638377B2

(12) United States Patent
Sommerer et al.

(10) Patent No.: US 9,638,377 B2
(45) Date of Patent: May 2, 2017

(54) METHOD FOR DETERMINING A VALUE OF A CURRENT

(75) Inventors: Andreas Sommerer, Kernen (DE); Sebastien Chatelain, Champagne au Mont d'Or (FR); Raphael Combe, Lyons (FR); Markus Viereck, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 483 days.

(21) Appl. No.: 14/345,281

(22) PCT Filed: Aug. 6, 2012

(86) PCT No.: PCT/EP2012/065320

§ 371 (c)(1),
(2), (4) Date: Nov. 25, 2014

(87) PCT Pub. No.: WO2013/041291

PCT Pub. Date: Mar. 28, 2013

(65) Prior Publication Data

US 2015/0068610 A1 Mar. 12, 2015

(30) Foreign Application Priority Data

Sep. 20, 2011 (DE) ..... 10 2011 083 068

(51) Int. Cl.

| | |
|---|---|
| ***F17D 3/01*** | (2006.01) |
| ***F02D 41/38*** | (2006.01) |
| ***F02D 41/24*** | (2006.01) |
| *F02D 41/20* | (2006.01) |

(52) U.S. Cl.

CPC ..... *F17D 3/01* (2013.01); *F02D 41/2464* (2013.01); *F02D 41/3863* (2013.01); *F02D 2041/2058* (2013.01); *Y10T 137/0379* (2015.04); *Y10T 137/7784* (2015.04)

(58) Field of Classification Search

CPC ..... F02D 2200/0602; F02D 2250/31; F02D 41/2464; F02D 41/3845; F02D 41/3863; F02D 2041/1409; F02D 2041/141; F02D 2041/1431; F02D 2041/2027; F02D 2041/2031; F02D 2041/2058;

(Continued)

(56) References Cited

U.S. PATENT DOCUMENTS

| | | | | |
|---|---|---|---|---|
| 5,992,391 A * | 11/1999 | Yamakado | F02D 41/20 | 123/490 |
| 6,367,452 B1 * | 4/2002 | Shima | F02D 41/3845 | 123/457 |
| 2007/0204832 A1 * | 9/2007 | Jung | F02D 41/042 | 123/319 |

FOREIGN PATENT DOCUMENTS

| | | |
|---|---|---|
| CN | 1090909 A | 8/1994 |
| CN | 101765713 A | 6/2010 |
| CN | 102052177 A | 5/2011 |

(Continued)

*Primary Examiner* — Vincent Q Nguyen
(74) *Attorney, Agent, or Firm* — Gerard Messina

(57) ABSTRACT

A method for determining a value of a current, which is required for changing a switching state of a pressure control valve of a fuel delivery system, in which the current flowing through the pressure control valve is varied from a starting value up to a target value, and a time curve of the current is analyzed, the value required for changing the switching state being reached when the curve of the current has a change in slope, this change being detected via a first derivation over time of the current.

10 Claims, 2 Drawing Sheets

(58) Field of Classification Search
CPC ..... F02D 2041/223; F02D 2041/224; F02D 2200/0604
USPC ..... 324/423, 522; 123/319, 459, 490
See application file for complete search history.

(56) References Cited

FOREIGN PATENT DOCUMENTS

| | | | |
|---|---|---|---|
| GB | 2 378 773 | A | 2/2003 |
| WO | 2005035959 | A1 | 4/2005 |

* cited by examiner

METHOD FOR DETERMINING A VALUE OF A CURRENT

FIELD OF THE INVENTION

The present invention relates to a method for determining a value of a current, a method for operating a fuel delivery system and a configuration having a control unit which is configured for determining a value of current.

BACKGROUND INFORMATION

Injection systems having a fuel accumulator and which are known as common rail injection systems have two actuators for pressure control, flow control being carried out by a metering unit (ZME) and pressure control via a pressure control valve (DRV). The pressure control valve may be operated strictly on a control basis in pressure control mode via the metering unit. Control of the pressure control valve is implemented in the pressure control mode, in such a way that the pressure control valve remains closed while taking into account all relevant sources of tolerance. If this is not ensured, then an unacceptable heating of the injection system and the fuel and the resulting increase in fuel consumption may be expected due to the resulting permanent leakage at the pressure control valve. High leakage may be detected by monitoring functions and then an emergency operation may be implemented.

In addition, the required reserve of tolerance at the pressure control valve may result in an injection system being operated with an excessively high opening pressure at the pressure control valve, depending on the tolerance situation. In the event of a defect, such as a stuck open metering unit, this may have the adverse effect that pressures prevail which are far greater than a nominal pressure of the injection system. The pressures occurring in such a fault case must not cause a failure of the injection system. If the pressures are too high, lines may rupture and cause fuel to escape into the engine compartment and result in a reduced stability or even failure of components of the injection system. Furthermore, excessively high pressures may result in loss of emergency driving ability to move a vehicle out of a danger zone. Taking into account a typical fault detection and response time, the components of the injection system must therefore be configured to be accordingly robust, which is complex and expensive.

So far, different adaptation functions are known for pressure control valves.

In one type of these adaptation functions for a pressure control valve, learning occurs only in pressure-controlled operation. Adaptation takes place in almost arbitrary or only slightly controllable boundary conditions with regard to a pressure and flow at the pressure control valve. A flow of fuel through the pressure control valve to be adapted is here always much greater than 0 L/h, which has a negative effect on the tolerance indication for the opening pressure of the pressure control valve. The highest pressure at which learning is typically possible with these functions is far below the pressure limit of the injection system. However, starting from this learned pressure, the tolerance indication deteriorates with an increase in pressure.

As an additional adaptation function, there is a known method in which the opening flow is ascertained by evaluating a rail pressure signal and/or a controller signal while the control current of the pressure control valve is varied.

The publication DE 10 2009 045 563 A1 discusses a method for determining at least one rail pressure closing current value pair for a pressure control valve of a common rail injection system of an internal combustion engine. In this method, the common rail injection system is operated in a metering unit-controlled mode, in which the trigger current for the pressure control valve is lowered, the pressure characteristic in the common rail over time is detected and the rail pressure is determined. The closing current is determined on the basis of the pressure characteristic thereby detected. Furthermore, a rail pressure closing current value pair is formed from the determined rail pressure and the determined closing current.

A method for operating a fuel system of an internal combustion engine is described in the publication DE 10 2004 059 330 A1, where a flow through a pressure control valve is taken into account as the basis for an adaptation function, the pressure control valve through which fuel may be discharged from a fuel pressure accumulator is precontrolled by a precontrol signal, which is ascertained by taking into account a setpoint pressure in the fuel pressure accumulator. A value for a quantity of fuel flowing through the pressure control unit is taken into account in ascertaining the precontrol signal.

Furthermore, additional publications for determining the operating parameters of injection systems are also known. Thus an individual pump characteristic line is learned in one method for operating an internal combustion engine using an injection system, which is discussed in the publication DE 10 2004 006 694 A1. In one method for operating a fuel injection system, which is discussed in the publication DE 10 2004 049 812 A1, an adaptation based on engine characteristics maps is carried out to balance out manufacturing tolerances in regulation of an operating parameter via a metering unit.

SUMMARY OF THE INVENTION

Against this background, a method having the features of the description herein, a method having the features of the further description herein and a configuration according to the further description herein are presented. Additional embodiments of the present invention are derived from the descriptions herein.

A pressure control valve usually has two switching states. This means that the pressure control valve is either closed (first switching state) or open (second switching state). During a change between switching states, the pressure control valve is either opened to go from the closed switching state to the open switching state or is closed to go from the open switching state to the closed switching state. A variable, by which the particular switching state of the pressure control valve is determined, is a current flowing through a coil of the pressure control valve. The current is usually increased or decreased for changing the switching state.

In one embodiment of the present invention, a current required for opening and/or closing the pressure control valve of an injection system may be detected and thus determined, the method provided here being robust with respect to a high pressure leakage because high requirements are not made of a stationary operating state of the injection system while it is learning the value for the current.

The analyzed variable is the current of the pressure control valve, the characteristic of which marks the opening point in time and/or the closing point in time of the pressure control valve. Together with the pressure of the fuel in a fuel accumulator applied at the point in time of opening and/or closing (rail pressure), a pair of values may be obtained from a value for the current and a value for the pressure, at least one such pair being used in a control unit (ECU) for providing, supplementing and/or correcting a characteristic of the pressure control valve. A more precise knowledge of the characteristic of the pressure control valve is then utilized to reduce the closing reserve, so it is possible to respond more quickly to fault situations by changing the switching state as the pressure control valve, whereby the pressure control valve is opened or closed, depending on the requirement.

The pressure control valve usually has a coil in which an armature which is movable in relation to the coil is situated. In this embodiment, the pressure control valve is opened or closed by the current flowing through the coil. An armature whose position and/or movement depend(s) on the flowing current may be situated inside the coil. An opening of the pressure control valve through which fuel may be discharged is acted upon via this armature.

A closing force, generated by the current for closing the pressure control valve or an opening force generated by the current for opening the pressure control valve, acts against an opening force or closing force in the opposite direction. The opening force or closing force, which is directed against a force, i.e., a closing force or an opening force generated by the current, is caused by the pressure of the fuel and possibly by a spring, for example.

Operation of a pressure control valve, which is closed by the current feed in accordance with the direction of action, is determined by an interaction of the closing force, which is caused by the current, and an opening force, which acts against it and is in turn caused by the pressure of the fuel within the fuel delivery system, e.g., by the pressure inside the fuel accumulator of the fuel delivery system.

The pressure at which the pressure control valve is opened so that fuel may be discharged from the fuel delivery system back into a tank may be set via a value of the current flowing through the coil of the pressure control valve. A first type of pressure control valve is opened at low currents, usually when the current is zero, whereas a second type of pressure control valve is closed at low currents, usually when the current is zero. Pressure control valves of the first type are closed by increasing the current. The higher the value set for the current, the higher is the pressure which the fuel must have in order to provide the opening force to overcome the closing force generated by the increased current. In the second type of pressure control valve, the pressure control valve is opened at an elevated current, so that an opening force is provided by the current which is the greater, the higher the current. Depending on the configuration of the pressure control valve, this opening force may act against a closing force generated by the pressure of the fuel, this closing force is the greater, the higher the pressure of the fuel. In other variants of the pressure control valves of the second type, a closing force may be generated by a spring while an opening force may also be generated by the pressure of the fuel, as is the case with pressure control valves of the first type, this opening force is the greater the higher the pressure of the fuel. The present invention may in general be used for pressure control valves, in which the opening force and closing force are the result of the interaction of a spring force, a magnetic force and/or a hydraulic force.

In one embodiment of the present invention, a change in the switching state is initially delayed by opening or closing the pressure control valve during coasting operation to optimize the guidance behavior of the high pressure controller. In this connection, the current at the pressure control valve is varied from a starting value continuously or in steps up to a target value until the pressure control valve is opened or closed. Depending on the type and/or operating mode of the pressure control valve, the current is reduced to the lower target value, starting from the starting value, in order to be able to either open or close it. Alternatively, the current is increased starting from the starting value and up to the higher target value in order to either open or close the pressure control valve.

The point in time of the change in the switching state, i.e., the opening or closing, is detectable in the curve of the current flowing through the pressure control valve regardless of the type of pressure control valve, since the induction by the moving armature results in a change in the slope in the curve of the current, which is detected via a first derivation over time of the current. In the first derivation over time of the current, for example, a plateau marking the start of a movement of the armature and thus the opening process or closing process of the pressure control valve becomes visible. It is also possible that the change in the curve of the current, indicating the point in time of the opening or closing, is detected via a peak in the derivation over time of the current.

The adaptation function used within the context of the method is used for learning and for correction of tolerances with respect to the characteristics of an opening pressure or closing pressure of a pressure control valve.

The configuration according to the present invention is configured to carry out all steps of the method presented for determining a value of the current and of the method for operating a fuel delivery system. Individual steps of at least one of these methods may also be carried out by individual components of the configuration. In addition, functions of the configuration or functions of individual components of the configuration may be implemented as steps of at least one of the methods. Furthermore, it is also possible to implement steps of at least one of the methods as functions of at least one component of the configuration or of the entire configuration.

Additional advantages and embodiments of the present invention are derived from the description and the accompanying drawings.

It is understood that the features mentioned above and those yet to be explained below may be used not only in the particular combination given but also in other combinations or alone without departing from the scope of the present invention.

DETAILED DESCRIPTION

Figure 1:
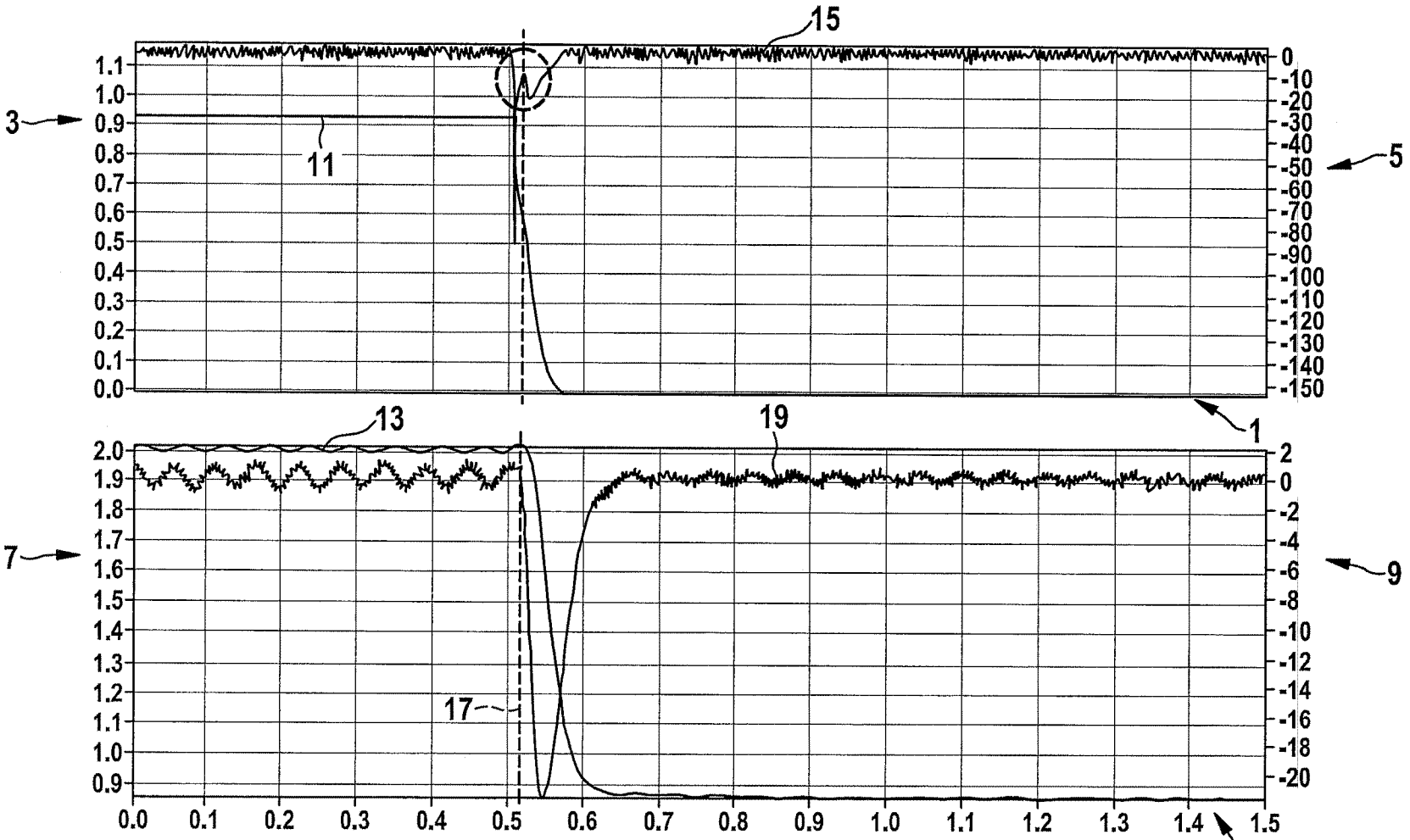
FIG. 1 schematically shows diagrams used in a possible specific embodiment of the method according to the present invention.

The present invention is schematically shown in the drawings on the basis of specific embodiments and is described in greater detail below with reference to the drawings.

The figures are described comprehensively and in general, using the same reference numerals to denote the same components.

Each of the diagrams shown in FIG. 1 has an abscissa 1, along which a time is plotted in seconds. In the first diagram, values for an electric current in amperes are plotted along a left ordinate 3. Values for a first derivation over time of the current in A/s are plotted along a right ordinate 5 in the first diagram. In the second diagram, it is provided that a pressure in kbar is plotted along a left ordinate 7 and a derivation over time of the pressure in kbar/s is plotted along a right ordinate 9.

In addition, the first diagram in FIG. 1 includes a time curve 11 of a current flowing through a pressure control valve of a fuel delivery system. An injection system of an internal combustion engine and thus cylinders of the internal combustion engine are supplied with fuel via this fuel delivery system.

It should be pointed out here that the value of a pressure of the fuel, whose curve 13 is depicted in the second diagram, is not too high. It is provided here that an opening force of the pressure control valve which is caused by the pressure of the fuel is compensated by a closing force of the pressure control valve, which is provided by the current flowing through a coil of the pressure control valve. Alternatively, it is possible for the closing force to be supplied by a spring of the pressure control valve and for the opening force to be supplied by the coil through which the current flows. The opening force of the pressure control valve is the greater the higher the current.

For carrying out a specific embodiment of the method according to the present invention, a value of the current, originating from a control unit and provided to the pressure control valve, is lowered to a target value from a starting value for changing a switching state of the pressure control valve, namely here for opening the pressure control valve. A time curve 11 of the current is detected by the control unit here.

In addition, a first derivation over time 15 of the current is calculated by the control unit and is also detected.

The first diagram therefore shows that the current, which is initially largely constant, is reduced sharply after about 0.5 second. It is provided that the starting value, i.e., the initial value, of the current is high enough to keep the pressure control valve closed at an instantaneously prevailing pressure of the fuel. As soon as the current, which is reduced from the starting value, has reached a value at which the pressure control valve is opened at an opening point in time 17, which is greater than 0.5 second, curve 11 of the current undergoes a change in slope. The change in slope of curve 11 of the current may be detected via a first derivation over time 15 of the current, for example, a feature in the course of first derivation over time 15. In the present specific embodiment, the first derivation over time 15 of the current, as shown by the first diagram, has a peak when the pressure control valve is opened on reaching a sufficiently reduced current. Alternatively or additionally, derivation 15 has a plateau at opening point in time 17. Opening point in time 17 of the pressure control valve is established by this value, which may be determined by analyzing the course of first derivation over time 15 of the current.

The second diagram in FIG. 1 also shows a first derivation over time 19 of the pressure of the fuel in addition to the pressure of the fuel. A course of first derivation over time 19 of the pressure indicates that this value also changes greatly on opening 17 of the pressure control valve.

In general, a value of the current, which is required for changing a switching state of a pressure control valve of a fuel delivery system, may be determined by this method. The current flowing through the pressure control valve changes in the direction of a target value from a starting value and a time curve of the current is analyzed, the value required for changing the switching state being reached when curve 11 of the current undergoes a change in slope, this change being detected via a first derivation over time 15 of the current.

A change in the switching state of the pressure control valve may include an opening of the pressure control valve, as depicted in the diagrams in FIG. 1 as an example, during which the current flowing through the pressure control valve is reduced from a starting value to a smaller target value. However, it is also possible for the pressure control valve to be closed by reducing the current, depending on the type and/or operating mode of the valve. Again in this case, the change in the switching state of a corresponding pressure control valve is detected by a change in the first derivation of the current.

Alternatively, a change in the switching state of the pressure control valve may include a closing of the pressure control valve during which the current flowing through the pressure control valve is increased from a starting value up to the larger target value.

In this case, the starting value or the initial value of the current is low enough so that the pressure control valve is open at an instantaneously prevailing pressure of the fuel. As soon as the current, which is increased starting from the starting value, has reached a value at a closing point in time at which the pressure control valve is closed, the curve of the current also undergoes a change in slope. Here again, the change in slope in the curve of the current may also be detected via the first derivation over time of the current, for example, a feature in the characteristic of the first derivation over time, the first derivation over time also having a peak and/or a plateau when the pressure control valve is closed on reaching a sufficiently elevated current. The closing point in time of the pressure control valve is established by this value, which may be determined by analyzing the course of the first derivation over time of the current.

In addition, depending on the operating mode and/or the type of pressure control valve, it is possible to open it by increasing the current from a starting value up to a target value. An opening point in time of the pressure control valve is also demonstrated in this case based on a change in the slope of the curve of the current, which is also indicated by a peak and/or a plateau as a feature in the course of the first derivation over time of the current.

For carrying out the method, the current may be varied continuously or in steps, i.e., increased or decreased.

Figure 2:
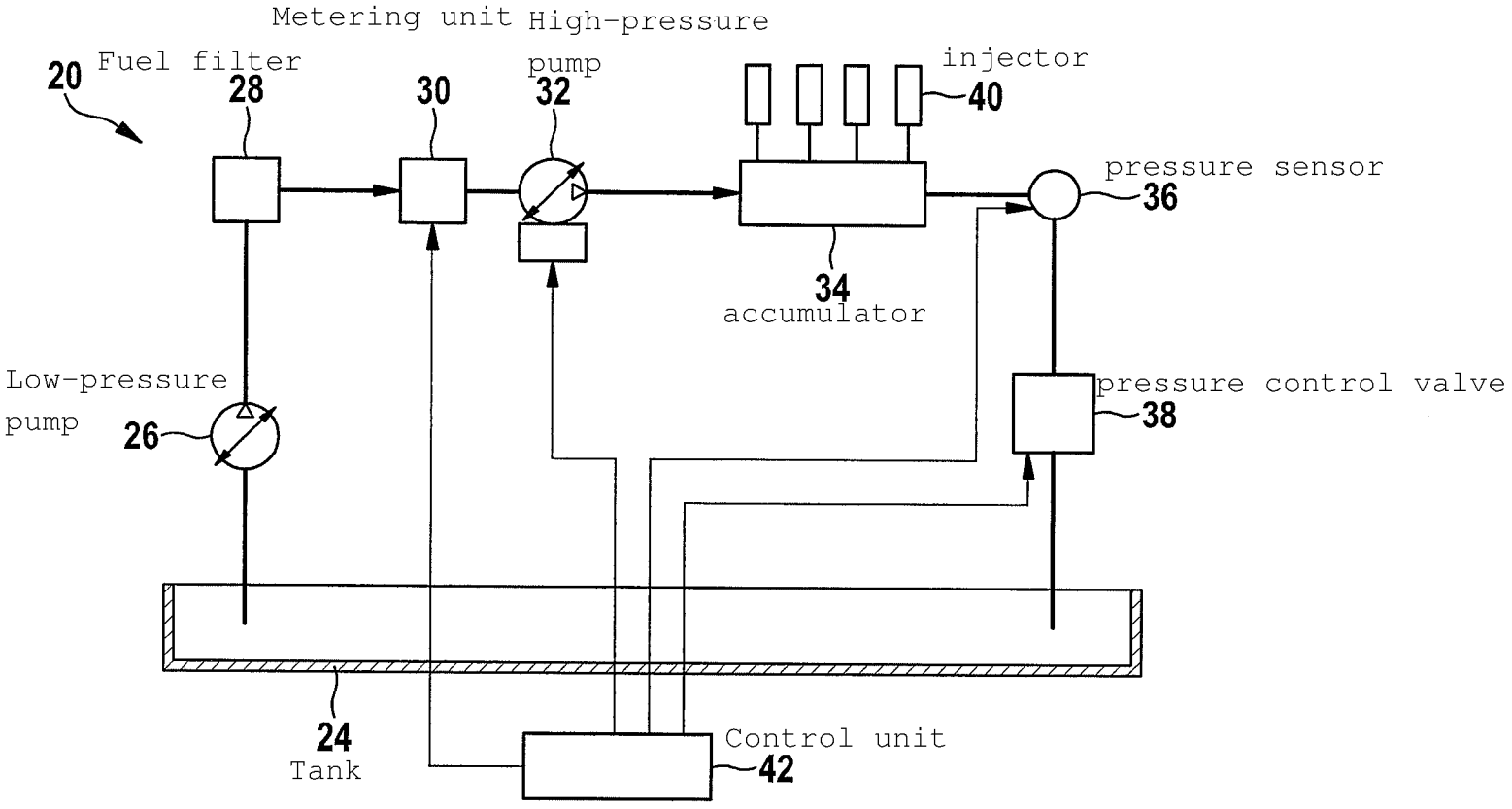
FIG. 2 schematically shows an example of a fuel delivery system and a specific embodiment of a configuration according to the present invention.

FIG. 2 schematically shows an example of a fuel delivery system 20, which is configured to supply fuel to cylinders of an internal combustion engine. In detail, fuel delivery system 20 includes a tank 24 for storing the fuel, a first electronic fuel pump configured as a low-pressure pump 26, a fuel filter 28, a metering unit 30, a second electronic fuel pump which is configured as a high pressure pump 32, a fuel accumulator 34, which is also known as a common rail, a pressure sensor 36 and a pressure control valve 38. The aforementioned components of fuel delivery system 20 are interconnected via fuel lines.

For operating fuel delivery system 20, fuel is delivered from tank 24 via low-pressure pump 26, fuel filter 28, metering unit 30 and high-pressure pump 32 to fuel accumulator 34, where the fuel is stored under pressure. Fuel accumulator 34 is connected to fuel injectors 40, each injector 40 being assigned to a cylinder of the internal combustion engine. If the pressure inside fuel delivery system 20 is too high, fuel may be discharged through pressure control valve 38 and returned to tank 24. A value at which pressure control valve 38 is opened is established by a current which flows through a coil of pressure control valve 38.

FIG. 2 also shows a control unit 42 as a component of a configuration 44 according to the present invention. Control unit 42 is connected to the components of fuel delivery system 20 and exchanges signals with it, these signals being sensor signals and actuator signals, so that control unit 42 is able to monitor, i.e., control and/or regulate, an operation of the components of fuel delivery system 20.

Control unit 42 is configured for determining a value of the current, which is required for changing a switching state, i.e., for opening or closing pressure control valve 38. The current flowing through pressure control valve 38 is therefore varied by control unit 42 from a starting value up to a target value, and a curve of the current is analyzed and thus monitored by control unit 42. Control unit 42 checks for which value of the current the curve of the current has a change in slope, this value being identified by control unit 42 as the value required for opening or closing. The change in slope may be detected by control unit 42 by analyzing and/or checking the first derivation over time of the curve of the current and is usually reached when the first derivation over time of the current has a certain feature, for example, a significant peak and/or a significant plateau. The current may be increased or decreased for opening, depending on the type and/or operating mode of pressure control valve 38 as a function of the provided change in the switching state. It is also possible to increase or decrease the current for closing pressure control valve 38, depending on its type and/or operating mode.

In addition, a value for the pressure at which pressure control valve 38 is opened or closed and which is measured by at least one pressure sensor 36 is assigned by control unit 42 to at least one value of the current. The control unit here supplies a characteristic of pressure control valve 38, which includes at least one pair of a value for the current and a value for the pressure, control unit 42 internally correcting the characteristic of pressure control valve 38. This characteristic may be supplemented by new pairs, each having a value for the current and a value for the pressure. Already existing pairs may be replaced by new pairs. The characteristic is usually updated during operation.

A method for determining the value of the current for opening or closing pressure control valve 38 may be carried out for a fuel delivery system of an internal combustion engine of a motor vehicle if the motor vehicle is in coasting mode. The opening or closing of pressure control valve 38 may be delayed to optimize a guidance behavior of a high-pressure controller of the fuel delivery system.

The method described here may be used in vehicles having a diesel engine and a common rail system having a pressure control valve 38 and a metering unit 30.

Regardless of the type and/or operating mode of pressure control valve 38, a change in the switching state of pressure control valve 38 is induced by a change in current from the starting value up to the target value of the current, the current being either decreased or increased; this pressure control valve 38 may be either opened or closed. The value of the current to be determined as part of the method described here, which causes the change in the switching state, is determined in all possible cases with regard to the type and/or operating mode of pressure control valve 38 on the basis of a change in the curve of the current, which is either increased or decreased, this change being detected by a feature in the first derivation over time of the current. It is possible here to either open or close a pressure control valve 38, depending on the type and/or operating mode by a decrease in the current or to either open or close the valve by an increase in the current.

What is claimed is:

1. A method for determining a value of a current, which is required for changing a switching state of a pressure control valve of a fuel delivery system, the method comprising:

varying the current flowing through the pressure control valve from a starting value up to a target value; and analyzing a time curve of the current, which time curve results from the varying, the analyzing including detecting for which value of the current the curve undergoes a change in slope and determining this current value as the value required for changing the switching state;

wherein the change in slope is detected based on a first derivation over time of the current.

2. The method of claim 1, wherein the value required for changing the operating state is reached when the first derivation over time of the current has a plateau and/or a peak.

3. The method of claim 1, wherein the current is for a fuel delivery system of an internal combustion engine of a motor vehicle when the motor vehicle is in coasting mode.

4. The method of claim 1, wherein a change in the switching state of the pressure control valve includes an opening or a closing of the pressure control valve.

5. The method of claim 1, wherein the current flowing through the pressure control valve is increased or decreased from a starting value up to the target value for changing the switching state of the pressure control valve.

6. The method of claim 1, wherein the current is varied in steps or continuously.

7. The method of claim 1, wherein a value for the pressure at which the switching state of the pressure control valve is changed is assigned to the at least one value of the current, and wherein there is a characteristic of the pressure control valve which includes at least one pair of a value for the current and a value for the pressure.

8. A system to determine a value of a current, comprising:

a control unit configured to determine the value of the current, which is required for changing a switching state of a pressure control valve of a fuel delivery system, wherein the control unit changes a current, which flows through the pressure control valve, from a starting value up to a target value and checks a resulting time curve of the current, wherein the control unit checks for which value of the current the curve of the current undergoes a change in slope and identifies this value as the value required for changing the switching state, and wherein the control unit detects this change in the slope based on a first derivation over time of the current.

9. The configuration of claim 8, further comprising:

at least one pressure sensor which is configured as a component of the fuel delivery system, wherein the control unit assigns a value for a pressure, at which the pressure control valve changes the switching state and which is measured by the at least one pressure sensor, to the value of the current, and the control unit provides a characteristic of the pressure control valve, including at least one pair of a value for the current and the value for the pressure.

10. The configuration of claim 9, wherein the control unit internally corrects the characteristic of the pressure control valve.

* * * * *